United States Patent [19]

Leaders et al.

[11] 4,371,504

[45] Feb. 1, 1983

[54] EXTRACTANT AND PROCESS FOR EXTRACTING URANIUM WET-PROCESS PHOSPHORIC ACID

[75] Inventors: William M. Leaders, Lakeland, Fla.; Charles D. Harrington, Pasco, Wash.

[73] Assignee: Uranium Recovery Corporation, Mulberry, Fla.

[21] Appl. No.: 88,152

[22] Filed: Oct. 25, 1979

Related U.S. Application Data

[63] Continuation of Ser. No. 772,818, Feb. 28, 1977, abandoned.

[51] Int. Cl.[3] ..... C01G 43/00

[52] U.S. Cl. ..... 423/10; 423/8; 423/18

[58] Field of Search ..... 423/10, 18, 8

[56] References Cited

U.S. PATENT DOCUMENTS

| | | | |
|---|---|---|---|
| 2,859,092 | 11/1958 | Bailes et al. | 423/10 |
| 2,859,094 | 11/1958 | Schmitt et al. | 423/20 |
| 2,947,774 | 8/1960 | Levine et al. | 423/10 |
| 3,034,854 | 5/1962 | Peppard et al. | 423/10 |
| 3,112,275 | 11/1963 | Pollock et al. | 423/10 |
| 3,320,033 | 5/1967 | Goren | 423/10 |
| 3,835,214 | 9/1974 | Hurst et al. | 423/10 |
| 3,987,145 | 10/1976 | Bruns et al. | 423/10 |
| 4,243,637 | 1/1981 | Bradford et al. | 423/10 |

OTHER PUBLICATIONS

Arnold (I), Report ORNL-5111, Chemistry Div. Ann. Prog. Report, period ending 11-1-1975, item 6.7, pp. 55-56 (Feb. 12, 1976).

Arnold (II), "Abstracts of Papers, 172nd ACS National Meeting", (San Francisco, Cal., 8-29 to 9-3, 1976) Abstract #40 & paper orally given, "Uranium Recovery from Wet Process Phosphoric Acid with Octylphenol Acid Phosphate".

Bartusek, "J. Inorg. Noel. Chem.", 29, 1089-1095 (1967).

Brown et al., "Proc. Second U.N. Inte. Conf. Peaceful Uses of Atomic Energy", vol. 3, pp. 472-487, United Nations (1958) Geneva.

Hurst et al. II, *Ind. Eng. Chem. Process Des. Develop.*, 13 (#3), 286-291 (1974).

*Primary Examiner*—Edward A. Miller

*Attorney, Agent, or Firm*—Fleit & Jacobson

[57] ABSTRACT

Uranium in wet-process phosphoric acid in the tetravalent state is extracted with a mixture of mono- and di-(alkylphenyl) esters of orthophosphoric acid containing a phenol modifier such as nonylphenol or octylphenol.

15 Claims, No Drawings

EXTRACTANT AND PROCESS FOR EXTRACTING URANIUM WET-PROCESS PHOSPHORIC ACID

This is a continuation application of Ser. No. 772,818, filed Feb. 28, 1977, now abandoned.

BACKGROUND OF THE INVENTION

This invention relates to the recovery of uranium from phosphate compounds and, more specifically, to the recovery of uranium from phosphoric acid produced by the acidulation of phosphate rock.

Most of the world's production of phosphate comes from marine phosphorites, and large deposits exist in Florida and the Western United States. These deposits generally contain from 50 to 200 ppm uranium (0.005 to 0.02%, or 0.1 to 0.4 pounds per ton). Although these concentrations are only 5% to 10% as high as those of commercially mined uranium ores, the vast extent of these deposits has made them of considerable interest as a uranium source for many years. It has been reported, for example, that mineable reserves of phosphate rock in the United States alone contain about 600,000 tons, or more than 1 billion pounds, of uranium.

A large and increasing portion of commercial phosphate production is converted first to a relatively dilute phosphoric acid by the so-called "wet-process" (as distinguished from the furnace process which produces elemental phosphorus by direct reduction of the ore). The producer first manufactures sulfuric acid, then uses it to digest the rock. The chemical reaction forms phosphoric acid and calcium sulfate. The latter is filtered out, providing enormous quantities of gypsum, a waste product, and leaving an acid stream typically containing about 30% $P_2O_5$. Most of the uranium in the original rock shows up in the 30% acid, and various extraction processes have been developed to extract it therefrom. The 30% acid is generally evaporated to about 54% "merchant acid", which is either sold or used to manufacture a variety of products, chiefly fertilizers. The higher the acid concentration, the harder it is to extract the uranium, so the 30% stage is where the uranium extraction must take place. If uranium is not extracted, it ends up as a minor impurity in the various end products.

A number of prior processes have been developed to recover the minor amounts of uranium contained in wet-process phosphoric acid. In many of these processes, any hexavalent uranium is first reduced to the tetravalent state by the addition of iron and then extracted by contacting the acid with an organic extractant which has a high extraction coefficient ($E_a^o$) for uranium in the tetravalent state. As is known, the coefficient of extraction ($E_a^o$) is a measure of the extraction power of a reagent and is defined as the ratio of the concentration of uranium in the organic phase to the concentration of uranium in the aqueous phase at equilibrium.

The United States Atomic Energy Commission has devoted considerable effort to the recovery of uranium from wet-process phosphoric acid beginning in the early 1950's. Primarily as a result of these efforts, the discovery was made that mixed organic phosphoric acid esters, such as pyrophosphoric acid esters of octyl alcohol, are good extractants for uranium in the tetravalent state. Continued research in this area led to the discovery by Murthy et al in 1970 (IAEA-SM-135/11) that a mixture of orthophosphoric acid esters of octylphenol has a higher extraction coefficient at corresponding emf of phosphoric acid than the monoesters, such as the octyl, isodecyl, and tridecyl esters of phosphoric acid. All these mixtures are more desirable than the pyrophosphoric acid esters because of their inherent stability; that is their slow rate of hydrolysis in comparison to the extremely high hydrolysis rates encountered when using the pyrophosphoric acid esters as first proposed in the early 1950's.

Murthy et al's work was continued by the Oak Ridge National Laboratory (ORNL), Oak Ridge, Tennessee, which demonstrated the process in bench-scale mixer-settler tests as reported in 1974 [Hurst et al, Ind. Eng. Chem., Process Des. Develop., 13,286]. However, subsequent work at ORNL has shown a selective loss of one of the mixed esters on repeated recycling of the reagent against phosphoric acid [Report 1976, Conf-760203-1].

We have found that the loss in extraction capability also observed by ORNL results from the precipitation of a ferric salt of the mixed esters. The analysis of this yellow precipitate has been established quite consistently. The apparent explanation for this precipitation is that most reagents that will extract uranium from phosphoric acid also have a significant affinity for other ions present, especially ferric ions. It is for this reason that uranium extraction is increased as the ferric ion concentration is reduced by substantial reduction of the emf of the phosphoric acid which is a measure of the ratio of the $Fe^{+3}/Fe^{+2}$. Since it is not economical or practical to undertake complete elimination of the ferric ion from wet-process phosphoric acid, it is desirable to find a means of eliminating the precipitation of the ferric salt of the mixed esters.

Accordingly, it is an object of the present invention to provide an improved process for extracting uranium from wet-process phosphoric acid.

A further object of the present invention is to provide an improved process for extracting uranium from wet-process phosphoric acid using mono- and di-(alkylphenyl) esters of orthophosphoric acid.

Still a further object of the present invention is to provide a process for extracting uranium from wet-process phosphoric acid using mono- and di-(alkylphenyl) esters of orthophosphoric acid in which the losses of the extractant are minimized.

Yet a further object of the present invention is to provide a process for extracting uranium from wet-process phosphoric acid having a lower $P_2O_5$ concentration than is possible using currently developed processes.

A still further object of the present invention is to provide a process for extracting uranium from wet-process phosphoric acid which is economical and minimizes the consumption of costly reagents.

SUMMARY OF THE INVENTION

These and other objects are accomplished according to the present invention by extracting the uranium in wet-process phosphoric acid in the tetravalent state with a mixture of mono- and di-(alkylphenyl) esters of orthophosphoric acid containing a modifier comprising an essentially water immiscible phenol such as nonylphenol or octylphenol.

We have found that using the modifier of the present invention effectively eliminates the precipitation of ferric salt of the mixed esters, makes the extractant extremely stable toward degradation and maintains its extraction power over many cycles. In pilot plant studies, we have recirculated the extractant on a 24-hour-a-day basis for as long as 30 days, at which time the supply of solvent was exhausted by normal losses from pump leakage, sampling, etc., and found that the extraction coefficient ($E_a^o$) maintained a constant level throughout the period. Also, throughout the entire period, we did not observe any decrease in the concentration of the mixed esters. We also did not observe any substantial yellow precipitate in the system during this continuous recirculating period.

Prior work with mixed esters indicated that precipitation problems are particularly acute when the $P_2O_5$ content of the wet-process acid drops below about 26%, which it frequently does when the wet-process acid plants become slightly out of balance. Under these low $P_2O_5$ concentrations, the extraction coefficients for both uranium and iron increase but the extraction coefficient for iron increases at a greater rate than uranium so that severe yellow precipitation problems occur in these circumstances. The modifier of the present invention, however, permits wet-process acid having a $P_2O_5$ content as low as about 15% to be treated without substantial yellow precipitate problems occurring.

Prior work also indicated that at about 25% concentration of the mixed esters, yellow precipitate formed regardless of the $P_2O_5$ concentration of the acid. Work with the modifier of the present invention has shown, however, that as high as 40% concentration of the mixed esters can be used without yellow precipitation problems and without adversely affecting phase separation. It has also been discovered that the addition of the modifier to as high as 40% concentration of the mixed esters will prevent precipitation which usually occurs when the solvent first contacts the wet-process acid. The importance of this is that by using as high a concentration of mixed esters as practicable greater uranium extraction is achieved in less equipment thus creating a substantial economic advantage.

DESCRIPTION OF THE PREFERRED EMBODIMENTS

In accordance with the present invention, wet-process phosphoric acid which is obtained by the acidulation of uncalcined phosphate rock with sulphuric acid and which typically contains 28 to 31% $P_2O_5$ is preferably treated so that any of the uranium in the phosphoric acid that may be in the hexavalent state is reduced to the tetravalent state. The reduction of any hexavalent uranium in the wet-process acid solution to tetravalent uranium is necessary accompanied by the reduction of other metallic impurities to lower oxidation states. Iron, for example, must be at least partially reduced from the ferric state to the ferrous state. More particularly, both total iron content and its oxidation state are significant, because iron interferes with uranium extraction as discussed above and also because the oxidation state of the iron tends to control the oxidation state of the uranium. However, to reduce the uranium it is necessary to reduce some or all of the iron in solution, and there is about 60 times as much iron as uranium. Only a small amount of the iron is typically found in the reduced (ferrous) state.

The ferric iron should be reduced such that the ferrous iron concentration is at least about 10% of the total iron content and preferably 20% or above to achieve a good extraction coefficient ($E_a^o$). Expressed in other terms, the emf of the phosphoric acid after reduction should be about 260 to 290 millivolts (mv). The emf of the phosphoric acid solution, or its oxidation potential measured against a standard calomel electrode, is a measure of the oxidation state of both iron and uranium, and typically is between 280 and 330 millivolts as produced in the phosphoric acid plant.

Reduction of the uranium from the hexavalent state to the tetravalent state may be carried out electrolytically or by the use of suitable reducing agents such as iron metal, aluminum and zinc, with iron metal being the preferred agent. An obvious advantage of electrolytic reduction is that no contaminating agents need be added to the wet-process acid. This reduction should be performed in an agitated vessel, preferably in a rotating cylinder, to keep the inorganic solids suspended.

The uranium in the wet-process phosphoric acid, in the tetravalent state, is extracted with a mixture of mono- and di-(alkylphenyl) esters of orthophosphoric acid containing a phenol modifier. The preferred mixed esters are prepared from commercially available octylphenol. The preferred mixture of esters is approximately an equimolar mixture of the mono- and di- esters. The phenol modifier broadly comprises any essentially water immiscible phenol which is soluble in the inert nonpolar diluent employed. The phenol can have one or two -OH groups and can be mono- or disubstituted by alkyl, alkylene or aryl in the ortho-, meta- or para-position relative to the -OH group(s). The alkyl and alkylene moieties are straight or branched chain radicals containing 1 to 20, preferably 6 to 12, carbon atoms. An example of an aryl substituted phenol is biphenyl phenol. The preferred modifiers are nonylphenol and octylphenol which are both commercially available. The commercially available octylphenol is in the form of para-1, 1, 3, 3, tetramethyl butyl phenol.

The ester mixture and modifier are employed in an inert nonpolar diluent. Suitable inert nonpolar diluents include, for example, aliphatic hydrocarbons, aromatic hydrocarbons, aromatic petroleum fractions, and chlorinated hydrocarbons. The preferred diluents are refined high-boiling, high-flash point petroleum fractions containing between 10 and 50% by volume naphthenes with the balance being principally aliphatic. The extractant solution should contain from about 10 to 40% by volume, and preferably about 20 to 30%, of the ester mixture. Greater than 40% by volume solutions of extractant can be used, but are not recommended since they result in poor phase separation. The extractant solution should also contain about 1 to 10% by volume, preferably 2 to 6%, of the modifier. Preferably, the extractant solution should contain about 2% by volume modifier at 20% by volume of mixed esters and the volume of modifier should be increased by about 1% as the volume of mixed esters if increased by about 5% (e.g. 4% by volume modifier at 30% by volume mixed esters). In general, the volume ratio of the wet-process acid to the extractant solution should be 5 to 7:1, with the preferred ratio being 6:1.

In carrying out this extraction step, the extractant and the wet-process phosphoric acid are intimately mixed together and then the phases are allowed to separate. This intimate intermixing can be accomplished either in a batch operation or in a continuous manner concurrently or countercurrently with countercurrent flow preferred. Apparatus for accomplishing intermixing and separation of two substantially immiscible phases are well known in the art and any conventional apparatus can be used for this purpose. It is preferred to operate the extraction in the aqueous continuous mode using a 6 to 8-stage countercurrent uranium extraction unit.

Preferably, the wet-process phosphoric acid should be maintained at a temperature of about 50° to 65° C. during this extraction step. By maintaining the wet-process phosphoric acid at this temperature, impurities such as calcium sulphate are kept in solution which leads to less scale formation in the system which results in less down time for cleanout being required. After the uranium is extracted, the wet-process phosphoric acid is returned to the phosphoric acid production plant to be evaporated to 54% merchant acid.

The use of a mixture of mono- and di-(alkylphenyl) acid phosphates results in good phase separation when the organic phase is separated from the aqueous phase after extraction. Furthermore, the mixed esters are comparatively inexpensive, have a low solubility in the acid, and remain stable over extended periods of use when extracting uranium from wet-process phosphoric acid, whereas other extractants break down over much shorter periods of use. Also, the extraction coefficient of other extractants usually varies with temperature, the extraction coefficient generally being higher at lower temperatures. While this is also true with the mixed ester extractants, they have good extraction coefficients even at the relatively high temperatures (i.e., 55°–70°) customary for fresh wet-process phosphoric acid.

The use of the modifier avoids the precipitation of ferric salt of the mixed esters, makes the extractant extremely stable toward degradation and maintains its extraction power over many cycles. The modifier also permits the extractant to be used with wet-process phosphoric acid containing less $P_2O_5$ (as low as about 15%) and permits a higher concentration of extractant in the diluent (up to 40%) to be used than has previously been possible.

After extraction, the uranium in the mixed ester extractant is stripped of its uranium content. This can be accompanied by oxidizing the uranium in the organic extractant to the hexavalent state and then stripping the uranium from the organic extractant with concentrated phosphoric or hydrochloric acid as shown in U.S. Pat. No. 2,859,092 to Bailes et al. The uranium can also be stripped from the organic extractant by means of oxidative stripping such as disclosed in U.S. Pat. No. 3,835,214 to Hurst et al. The extractant withdrawn from the stripping apparatus, now substantially free of its uranium content, is recycled and contacted with more wet-process phosphoric acid. The uranium in the stripping solution is then recovered by conventional technique such as shown in the Bailes et al and Hurst et al patents.

To facilitate understanding the advantages and operation of the present invention, the following examples are provided to specifically illustrate the use of a phenol modifier in extracting uranium from wet-process phosphoric acid and, in the case of Examples 2 and 3, to compare these results with those obtained using an alkanol modifier (i.e., isodecanol).

EXAMPLE 1

Five volumes of an equimolar mixture of mono- and di-(octylphenyl) esters of orthophosphoric acid (OPPA) in kerosene in a concentration of 20% by volume were prepared with the following octylphenol (OP) additions in percent by volume:

(a) Organic No. 1—0% OP (control)
(b) Organic No. 2—0.5% OP
(c) Organic No. 3—1.0% OP
(d) Organic No. 4—2.0% OP
(e) Organic No. 5—5.0% OP In order to determine the effectiveness of the octylphenol modifier in the presence of high quantities of ferric iron, the five organics were used to extract uranium from fresh, unreduced wet-process phosphoric acid containing about 28% $P_2O_5$ and the uranium was stripped from the organics with a phosphoric acid stripping solution. The uranium extraction and stripping operations are referred to below as a "cycle". The uranium extraction was conducted in a 2-stage countercurrent operation at an acid temperature of 55° C. and at an aqueous to organic ratio of 6:1 (600 cc:100 cc). The uranium in the organics were then oxidized to the hexavalent state and the uranium stripped from the organics in a 1-stage countercurrent operation. The following processing conditions were also followed and observations made:

1. After three (3) continuous cycles with each organic, no ferric salt precipitation (yellow solids; Fe-OPPA) had formed.
2. Between the third and fourth cycles, there was a two-day gap during which the organics set in the barren stage at 55° C. Two of the organics precipitated out yellow solids. The organics were Nos. 1 (0.0431 gram) and 2 (0.0153 gram).
3. No further yellow solid precipitation occurred during the fourth and fifth cycles.
4. Between the fifth and sixth cycles, there was a 24-hour gap during which the organics again set in the barren stage at 55° C. which resulted in all of the organics precipitating out yellow solids. However, the Nos. 4 and 5 organics only showed trace amounts of yellow solids (0.0204 and 0.0168 gram, respectively).
5. Organics Nos. 1, 2 and 3 were discontinued after the sixth cycle because they had shown substantial amounts of yellow precipitation (0.4169, 0.6630 and 0.1300 gram, respectively).
6. Organics Nos. 4 and 5 were continued for a total of 13 cycles and, except for the one instance between cycle 5 and 6, neither organic precipitated out any yellow solids. This included a two-day gap between the twelfth and thirteenth cycles during which the organics set in the barren stage at 55° C.
7. The extraction coefficient ($E_a^o$) data showed essentially no difference in extraction (±1.0) between the five organics tested.

EXAMPLE 2

Four volumes of an equimolar mixture of OPPA in a non-aromatic kerosene distillate in a concentration of 30% by volume were prepared with the following octylphenol (OP), nonylphenol (NP) and isodecanol additions in percent by volume:

(a) Organic No. 1—0% Modifier (control)
(b) Organic No. 2—5% OP
(c) Organic No. 3—5% NP
(d) Organic No. 4—5% Isodecanol In order to determine the effectiveness of the modifiers in the presence of high quantities of ferric iron, the four organics were used to extract uranium from fresh, unreduced wet-process phosphoric acid containing about 28% $P_2O_5$. The uranium extraction comprised eight successive 1-stage countercurrent contacts between the acid and each of the organics at an acid temperature of 55° C. and at an aqueous to organic ratio of 6:1 (600 cc:100 cc). After extraction, the organics were allowed to settle at room temperature (25° C.) for 24 hours.

The wet-process acid used for the first four contacts with each of the organics had a total iron concentration of 12.4 g/l, a ferrous iron concentration of 0.62 g/l, a uranium concentration of 189 mg/l, an emf of 312 and a specific gravity of 1.3555. The wet-process acid used for the last four contacts with each of the organics had a total iron concentration of 12.85 g/l, a ferrous iron concentration of 0.20 g/l, a uranium concentration of 189 mg/l, an emf of 332 and a specific gravity of 1.346.

The following observations were made:

1. No yellow solid (Fe-OPPA) was formed by any of the organics during uranium extraction.

2. Only organics Nos. 1 and 4 formed yellow solid during the 24-hour settling period (0.3834 and 0.3675 grams, respectively).

3. Nonylphenol and octylphenol worked equally as well as modifiers in preventing yellow solid formation.

4. Isodecanol in a 5% concentration does not act as an acceptable modifier in preventing yellow solid formation.

EXAMPLE 3

Five volumes of an equimolar mixture of OPPA in a non-aromatic kerosene distillate in a concentration of 30% by volume were prepared with the following octylphenol (OP), nonylphenol (NP) and isodecanol additions in percent by volume:

(a) Organic No. 1—0% Modifier (control)
(b) Organic No. 2—5% NP
(c) Organic No. 3-5% Isodecanol
(d) Organic No. 4—10% Isodecanol
(e) Organic No. 5—5% OP The five organics were used to extract uranium from fresh, reduced wet-process phosphoric acid containing about 28% $P_2O_5$, a total iron concentration of 13.74 g/l, a ferrous iron concentration of 2.07 g/l, a uranium concentration of 164 mg/l, an emf of 284 and a specific gravity of 1.3455. The uranium extraction comprised either successive 1-stage countercurrent contacts at an acid temperature of 55° C. and at an aqueous to organic ratio of 6:1 (600 cc:100 cc). The organics were allowed to settle for approximately 16 hours after the first, sixth and eighth contacts with the acid. Samples were taken for uranium analysis.

The following observations were made:

1. No yellow solid (Fe-OPPA) was formed by any of the organics during contacts with the acid.

2. Only Organics Nos. 1, 3 and 4 formed yellow solid during the 16-hour settling periods. Organics Nos. 1 and 3 formed 3.076 and 2.2807 grams of yellow solid, respectively. Organic No. 4 formed yellow solid only during the settling period after the eighth contact (0.3958 grams).

3. Nonylphenol and octylphenol worked equally as well as modifiers in preventing yellow solid formation.

4. A 5% concentration of isodecanol is insufficient to inhibit yellow solid formation; however, a 10% concentration worked better.

5. Isodecanol reduced by approximately one-half the extraction capability of OPPA.

6. Nonylphenol and octylphenol did not substantially affect the extraction capability of OPPA, but both effectively inhibited the formation of yellow solids.

As will be readily understood by those of ordinary skill in the art, minor modifications may be made in the process described above without in any way departing from the spirit and scope of the invention. Accordingly, it is understood that the invention will not be limited to the exact details disclosed above, but will be defined in accordance with the appended claims.

We claim:

1. In a process for extracting tetravalent uranium from wet-process phosphoric acid containing ferric iron with an extractant comprising a solution of a mixture of mono- and di-(alkylphenyl) esters of orthophosphoric acid in an inert diluent in which said ferric iron contained in the wet-process phosphoric acid combines with the mixed esters to form a precipitate, the improvement comprising modifying the process by adding to the extractant an essentially water-immiscible phenol in a concentration sufficient to substantially prevent formation of said precipitate.

2. The process of claim 1 wherein said concentration is about 1 to 10% by volume.

3. The process of claim 1 wherein said concentration is about 2 to 6% by volume.

4. The process of claim 1 wherein said extractant comprises a mixture of mono- and di-(octylphenyl) esters of orthophosphoric acid.

5. The process of claim 1 wherein said modifier is an unsubstituted phenol or a mono- or disubstituted phenol having one to two -OH groups, said substituents being an alkyl or alkylene group or groups having 1 to 20 carbon atoms or an aryl group.

6. The process of claim 1 wherein said modifier is nonylphenol or octylphenol.

7. In a process for extracting uranium from wet-process phosphoric acid containing ferric iron with an extractant comprising an about 10 to 40% by volume solution of a mixture of mono- and di-(alkylphenyl) esters of orthophosphoric acid in an inert diluent in which said ferric iron contained in the wet-process phosphoric acid combines with the mixed esters to form a precipitate, the improvement comprising adding about 1 to 10% by volume of an essentially water-immiscible phenol to the extractant to substantially prevent formation of said precipitate.

8. The process of claim 7 wherein said modifier is an unsubstituted phenol or a mono- or disubstituted phenol having one to two -OH groups, said substituents being an alkyl or alkylene group or groups having 1 to 20 carbon atoms or an aryl group.

9. The process of claim 7 wherein said modifier is nonylphenol or octylphenol.

10. The process of claim 7 wherein said extractant comprises a mixture of mono- and di-(octylphenyl) esters of orthophosphoric acid.

11. A process for the recovery of uranium from wet-process phosphoric acid derived from the sulfuric acid acidulation of uncalcined phosphate rock comprising adding about 1 to 10% by volume of a modifier to an extractant comprising an about 10 to 40% by volume solution of a mixture of mono- and di-(alkylphenyl) esters of orthophosphoric acid in an inert diluent, said modifier comprising an essentially water-immiscible phenol, contacting wet-process phosphoric acid containing tetravalent uranium and ferric iron with said modified extractant to extract said tetravalent uranium from said wet-process phosphoric acid while substantially preventing formation of a precipitate of the mixed esters with said ferric iron, and contacting the pregnant extractant with a strip solution to strip said uranium into said strip solution.

12. The process of claim 11 wherein said extractant is a mixture of mono- and di-(octylphenyl) esters of orthophosphoric acid.

13. The process of claim 11 wherein said modifier is an unsubstituted phenol or a mono- or disubstituted phenol having one to two -OH groups, said substituents being an alkyl or alkylene group or groups having 1 to 20 carbon atoms or an aryl group.

14. The process of claim 11 wherein said modifier is nonylphenol or octylphenol.

15. The process of claim 7 wherein said extractant contains 20 to 30% by volume of said mixture of esters and about 2 to 4% by volume of said modifier is added to said extractant.

* * * * *